US006652228B2

(12) United States Patent
Tiemann

(10) Patent No.: US 6,652,228 B2
(45) Date of Patent: Nov. 25, 2003

(54) GAS TURBINE BLADE AND GAS TURBINE

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/032,926

(22) Filed: Dec. 27, 2001

(65) Prior Publication Data

US 2002/0182067 A1 Dec. 5, 2002

(51) Int. Cl.[7] ..... F01D 9/04
(52) U.S. Cl. ..... 415/178; 415/191
(58) Field of Search ..... 415/177, 178, 415/139, 191, 208.2; 416/191, 193 A

(56) References Cited

U.S. PATENT DOCUMENTS 3,867,065 A * 2/1975 Schaller et al. ..... 415/209.4
4,643,636 A * 2/1987 Libertini et al. ..... 415/138
5,269,651 A 12/1993 Ostermeir et al.
5,492,445 A * 2/1996 Shaffer et al. ..... 415/136
6,051,277 A 4/2000 Claussen et al.
6,235,370 B1 * 5/2001 Merrill et al. ..... 428/116

FOREIGN PATENT DOCUMENTS

| | | |
|---|---|---|
| DE | 26 28 708 | 6/1976 |
| JP | 01 285603 | 5/1988 |
| WO | WO 00/57032 | 3/2000 |

* cited by examiner

*Primary Examiner*—Ninh H. Nguyen
(74) *Attorney, Agent, or Firm*—Harness, Dickey & Pierce, P.L.C.

(57) ABSTRACT

Disclosed is a gas turbine blade, in which a ceramic covering, which is mechanically fastened to a metal platform, is arranged in a manner that the metal platform is protected against a hot gas in a hot gas duct of a gas turbine.

20 Claims, 3 Drawing Sheets

GAS TURBINE BLADE AND GAS TURBINE

This application claims priority under 35 U.S.C. § 119 of German Patent Application 00128576.6, the entire contents of which are hereby incorporated by reference.

1. Field of the Invention

The present invention generally relates to a gas turbine blade, having a blade aerofoil and a platform region adjacent to the blade aerofoil and bounding a hot gas duct of a gas turbine in which the gas turbine blade may be installed. The present invention also generally relates to a gas turbine with such a gas turbine blade.

2. Background of the Invention

A gas turbine blade is apparent from DE 26 28 807 A. The gas turbine blade is aligned along a blade axis and has a blade aerofoil and a platform region along the blade axis. In the platform region, a platform extends radially outward from the blade aerofoil transverse to the blade axis. Such a platform forms a part of a flow duct for a working fluid, which flows through a gas turbine in which the turbine blade is installed. In a gas turbine, very high temperatures occur in this flow duct. In consequence, the surface of the platform exposed to the hot gas is subject to severe thermal effects. This demands cooling of the platform.

In order to cool the platform, a perforated wall element is arranged in front of the side of the platform facing away from the hot gas. Cooling air passes via the holes in the wall element and impinges on the side of the platform facing away from the hot gas. In a gas turbine, cooling air for the components to be cooled is generally tapped off from a compressor, which generates compressed air for the combustion in the gas turbine. The air quantity which can be supplied to the combustion process is reduced because cooling air is tapped off. This reduces the efficiency of the gas turbine. Efforts are correspondingly made to keep the cooling air consumption in a gas turbine as low as possible.

WO 00/57032 A1 reveals a guide vane for a gas turbine in which the platform is embodied as a separate component for simplification of the covering technology in a casting process. This separate platform component may also include a ceramic material.

U.S. Pat. No. 5,269,651 shows a ceramic guide vane ring which is movably held at its inside by compression of a clamping element. In this arrangement, the inner ring is subdivided into a plurality of piston-ring type elements. Compensation may be provided, by this arrangement, for the axial displacement between the outer and inner casings.

In the Patent Abstracts of Japan, Vol. 014, No. 060 (M-0931), 05.02.1990, a gas turbine guide vane is shown which includes a ceramic shell which is supported by a metallic insert. A thermally insulating layer is arranged between the ceramic shell and the metallic insert.

U.S. Pat. No. 3,867,065 shows a fully ceramic rotor blade arrangement for gas turbines. An annular ceramic insulator is arranged on the inner surface of the inner periphery of the rotor blade structure in order to avoid heat transfer and thermal gradients.

SUMMARY OF THE INVENTION

An object of the present invention is to provide a gas turbine blade that has a particularly low requirement for cooling air.

A further object of the present invention is to provide a gas turbine with a particularly low requirement for cooling air.

An object directed toward a gas turbine blade is achieved, according to the present invention, by the provision of a gas turbine blade, having a blade aerofoil and a platform region, adjacent to the blade aerofoil and bounding a hot gas duct of a gas turbine in which the gas turbine blade may be installed, the platform region having a metal platform on which a ceramic covering is supported and fastened by way of a mechanical fastening device.

The present invention initiates a completely new way of providing the platform of a gas turbine blade, where platform bounds the hot gas duct, with a mechanically fastened ceramic covering. The metal platform is effectively screened from hot gas flowing through the hot gas duct by the ceramic covering. Correspondingly, the metal platform requires distinctly less cooling. Under certain circumstances, it may even be possible to dispense entirely with cooling of the metal platform. The result of this is a substantially reduced requirement of cooling air, which in turn increases the efficiency of the gas turbine in which the gas turbine blade is installed.

The gas turbine blade of the type proposed may, furthermore, be easily manufactured because it is only necessary to change a conventional gas turbine blade somewhat with respect to its radial dimensions. Thus, the ceramic covering may be positioned flush to the hot gas duct.

In other respects, the gas turbine blade may be conventionally manufactured, in particular by casting. The ceramic covering can be later supported and fastened onto the metal platform by way of the mechanical fastening element. In particular, it is possible to install such gas turbine blade in a blade ring in the gas turbine and, in the process, join the ceramic covering, piece by piece, to each installed gas turbine blade. Therefore, the result is a complete and closed blade ring, which additionally clamps the ceramic coverings from falling out.

The ceramic covering may also be exchanged later in a simple manner, perhaps during routine servicing, by simply supporting it on the metal platform and fastening it by way of the fastening element.

a) The ceramic covering preferably includes two halves. One half is, furthermore, preferentially adjacent to a suction surface of the blade aerofoil and the other half is adjacent to a pressure surface of the blade aerofoil. The application of the ceramic covering is then of particularly simple arrangement because the two halves of the ceramic covering are simply attached around the blade aerofoil.

b) The mechanical fastening device is preferably a spring, which is firmly connected to the gas turbine blade. A sprung fastening of the ceramic covering is therefore achieved by way of the fastening device. This has, in particular, the advantage that any vibrations of the gas turbine blade are transferred in a damped manner to the ceramic covering, which reduces any danger of fracture to the ceramic covering. In addition, the spring preferably engages in a groove of the ceramic covering, which groove extends along a narrow side adjacent to the blade aerofoil.

c) A fixing pedestal is preferably arranged on the metal platform, which pedestal engages in the ceramic covering. By way of such a fixing pedestal, the ceramic covering is fixed, against sliding on the metal platform, additionally to the fastening by way of the fastening element.

d) The gas turbine blade is preferably configured as a guide vane, which has a second platform region which, together with the platform region, encloses the vane aerofoil and is opposite to the platform region. The second platform region has a second metal platform on which a second ceramic covering is supported and is fastened by way of a second mechanical fastening device. A gas turbine guide vane usually has two platform regions. One platform region is adjacent to an engagement arrangement of the gas turbine guide vane by way of which the gas turbine guide vane is engaged in a casing of a gas turbine. The second platform region bounds the hot gas duct opposite to a gas turbine rotor. Both platform regions can be provided with a ceramic covering.

e) The ceramic covering preferably has an integral mat, by way of which the fragments are held as a composite in the event of a fracture of the ceramic covering. Ceramic is substantially more brittle than metal and is subject to the danger of splintering, perhaps on the impingement of a solid body flowing in the hot gas duct. In the case of a fracture of the ceramic covering, fragments could pass into the hot gas duct and damage subsequent turbine blading stages in the hot gas duct. This is prevented by the integral mat of the ceramic covering. In the case of a fracture of the ceramic covering, the fragments are held together by the mat. The mat may, for example, be introduced into the ceramic covering, for example by casting it in during the manufacture of the ceramic covering. The mat may also, however, be joined to the bottom of the ceramic covering.

f) The ceramic covering preferably exhibits mullite. Mullite is a particularly suitable material with particularly suitable properties in terms of thermal resistance and also in terms of resistance to oxidation and corrosion.

g) The ceramic covering preferably has an outer sealing to combat particle separation. The ceramic covering may include a ceramic basic body whose surface tends to release solid body particles. These may have an erosive effect in the subsequent hot gas duct on the gas turbine blading which follows there. A sealing layer combats this release of particles.

The embodiments described in the paragraphs a) to g) can be combined together in any given manner.

According to the present invention, the object directed toward a gas turbine is achieved by the provision of a gas turbine with a gas turbine blade according to one of the embodiments described above.

The advantages for such a gas turbine follow correspondingly from the above statements relating to the advantages of the gas turbine blade.

The gas turbine blade is preferably arranged, in the axial direction of a flow duct of a gas turbine, between two rotor blades, whereby the second ceramic covering extends in the axial direction just so far as not to be rubbed by one of the rotor blades. This reliably prevents the ceramic covering from being damaged by a rub due to the rotor blades respectively adjacent to it and rotating past it.

BRIEF DESCRIPTION OF THE DRAWINGS

Using the drawings, the invention is explained, as an example, in more detail. Partially diagrammatically and not to scale.

DETAILED DESCRIPTION OF THE PREFERRED EMBODIMENTS

The same designations have the same significance in the various figures.

Figure 1:
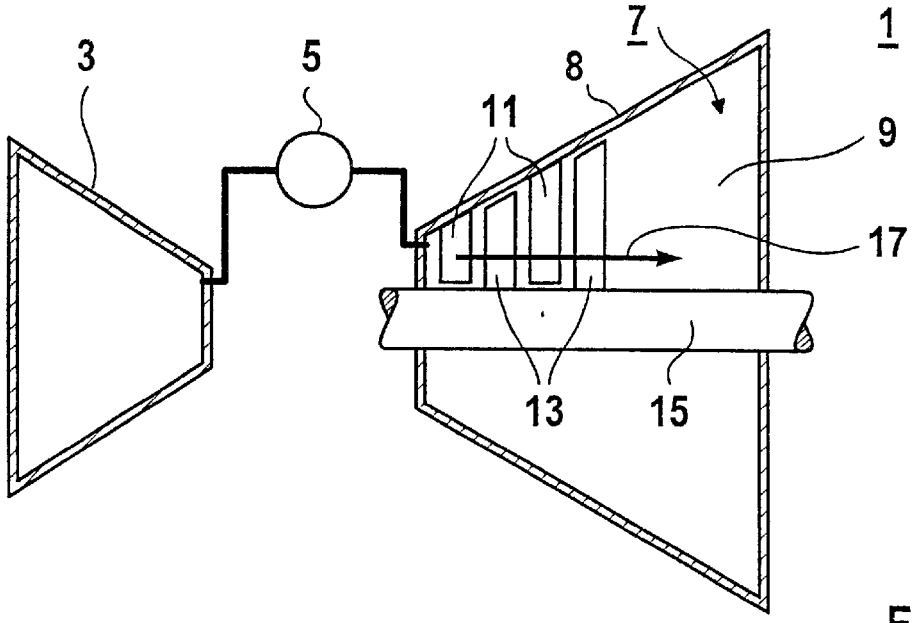
FIG. 1 shows a gas turbine.

FIG. 1 shows, diagrammatically, a gas turbine 1. The gas turbine 1 has a compressor 3, a combustion chamber 5 and a turbine part 7 connected in sequence. The turbine part 7 has a hot gas duct 9. Guide vanes 11 are arranged in the hot gas duct 9, and are connected to a casing 8 of the turbine part 7. Rotor blades 13, which are connected to a gas turbine rotor 15, are also arranged along the hot gas duct 9, alternating with the guide vanes 11 in the hot gas duct 9.

During operation of the gas turbine 1, air is compressed in the compressor 3 and supplied to the combustion chamber 5. It is there burnt with the addition of fuel. The resulting hot exhaust gas 17 subsequently flows through the hot gas duct 9 and puts the gas turbine rotor 15 into rotation by way of an action on the rotor blades 13. The very hot gas 17 has very strong thermal effects on the gas turbine blade 11, 13 arranged in the hot gas duct 9 very severely. For this reason, the gas turbine blade 11, 13 are cooled from the inside by air from the compressor 3. This cooling air from the compressor 3 is no longer available for combustion in the combustion chamber 5. Because of this, the efficiency of the gas turbine 1 is reduced. An effective measure for economizing in cooling air is explained in more detail using FIGS. 2 to 4.

Figure 2:
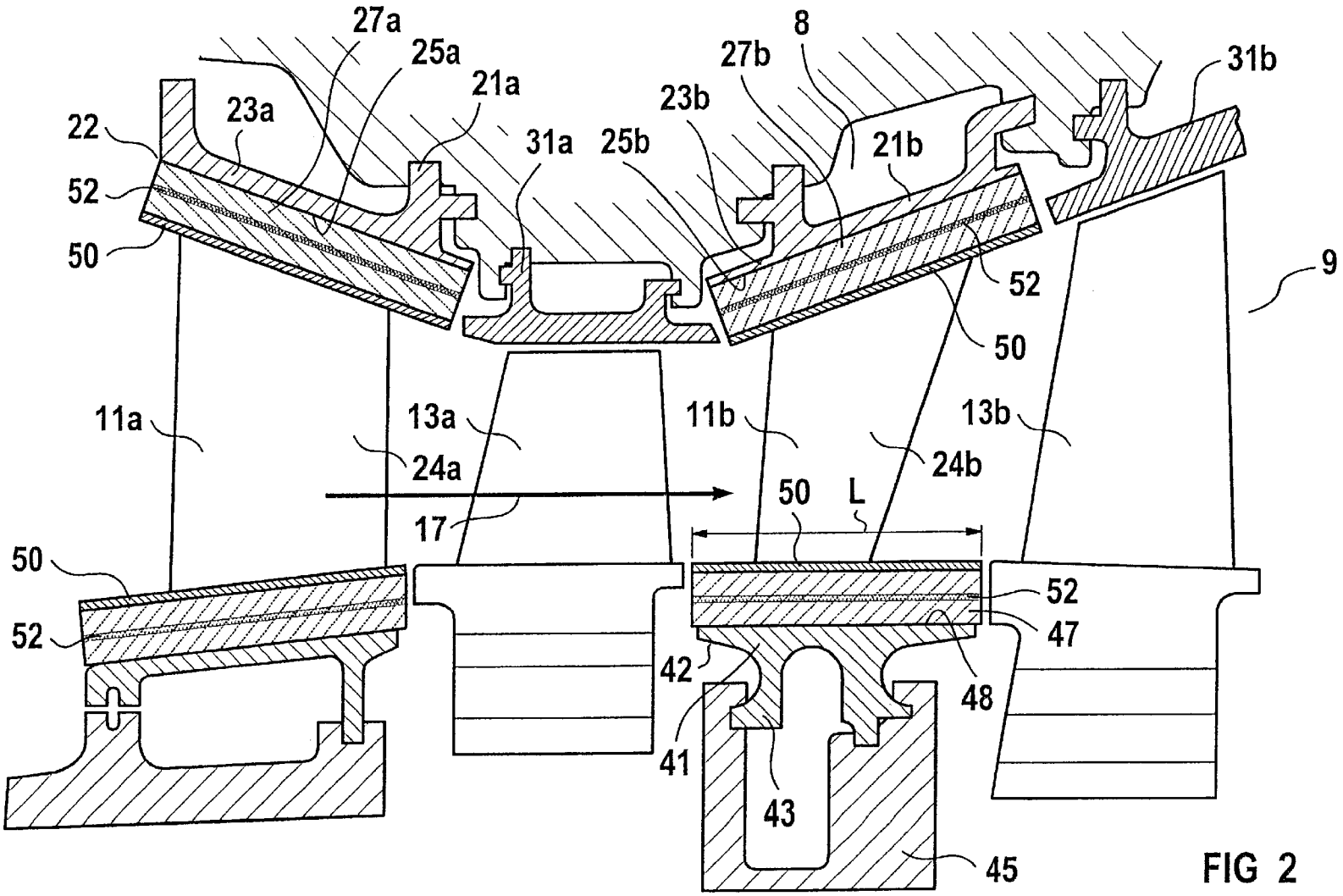
FIG. 2 shows a part of the hot gas duct of a gas turbine.

FIG. 2 shows an excerpt from the hot gas duct 9 of a gas turbine 1. Hot gas 17 entering from the combustion chamber is introduced into the hot gas duct 9 via a first guide vane 11*a*. The first guide vane 11*a* is part of a first guide vane ring (not shown). A first rotor blade 13*a* follows the first guide vane 11*a* in the flow direction of the hot gas 17. A second guide vane 11*b* follows the first rotor blade 13*a* in the flow direction of the hot gas 17. A second rotor blade 13*b* follows the second guide vane 11*b* in the flow direction of the hot gas 17. Further blading stages may follow in the hot gas duct 9. The first guide vane 11*a* is connected to the casing 8 of the gas turbine 1 by way of a fastening region 21*a*. A platform region 22 with a metal platform 23*a* abuts the fastening region 21*a*. The metal platform 23*a* has a surface 25*a* facing toward the hot gas duct 9. A ceramic covering 27*a* is supported on the surface 25*a*. The fastening of the ceramic covering 27*a* will be explained later using FIG. 4.

The second guide vane 11*b* is fastened in an analogous manner to the casing 8 by way of its fastening region 21*b* and likewise has a ceramic covering 27*b* on its metal platform 23*b*. The second guide vane 11*b* has, adjacent to the ceramic covering 27*b*, a vane aerofoil 24*b* which passes through the hot gas duct 9. At its radially inner end, the vane aerofoil 24*b* is bounded by a second ceramic covering 47, which is supported on the side 48, which faces toward the hot gas duct 9, of a second metal platform 41, which is associated with a second platform region 42. The second metal platform 41 is adjacent to an inner ring engagement 43, which carries an inner ring 45. The radially inner end of the first guide vane 11*a* is also designed in a similar manner.

The metal platforms 23*a*, 23*b*, 41 respectively located under the ceramic coverings 27*a*, 27*b*, 47 are protected from the hot gas 17 by them. It is practically unnecessary to cool the thermally very resistant ceramic coverings 27*a*, 27*b*, 47 by cooling air. The necessity for cooling also substantially disappears in the case of the metal platforms 23*a*, 23*b*, 41. This substantially reduces the cooling air requirement for the gas turbine 1. This, in turn, results in an increase in efficiency of the gas turbine 1. Mechanically joining the ceramic coverings 27*a*, 27*b*, 47 to the metal platforms 23*a*, 23*b*, 41 provides, in addition, a design which is simple and very favorable from the point of view of manufacturing technology and one which can also be maintained rapidly and at low cost in a simple manner by exchanging the ceramic coverings 27*a*, 27*b*, 47 during a later service operation.

The ceramic covering 47 has an axial length L which is precisely dimensioned so that the adjacent rotor blades 13*a*, 13*b* do not rub. This excludes the possibility of the rotating rotor blades 13*a*, 13*b* damaging the ceramic coverings 47. The basic body of the ceramic coverings 27*a*, 27*b*, 47 includes mullite and they have, in addition, an outer sealing layer 50, which prevents separation of solid body particles. Such solid body particles could, otherwise, have an erosive effect on the gas turbine blades 11, 13 arranged in the hot gas duct 9. Each ceramic covering 27*a*, 27*b*, 47 has, in addition, an integral mat 52 which is cast into the basic ceramic body. In the case of a possibly occurring fracture in one of the ceramic coverings 27*a*, 27*b*, 47, this mat prevents fragments passing into the hot gas duct 9, which may damage gas turbine blades 11, 13. The fragments are held as a composite by the mat 52. The damaged ceramic covering can be exchanged as opportunity occurs.

Figure 3:
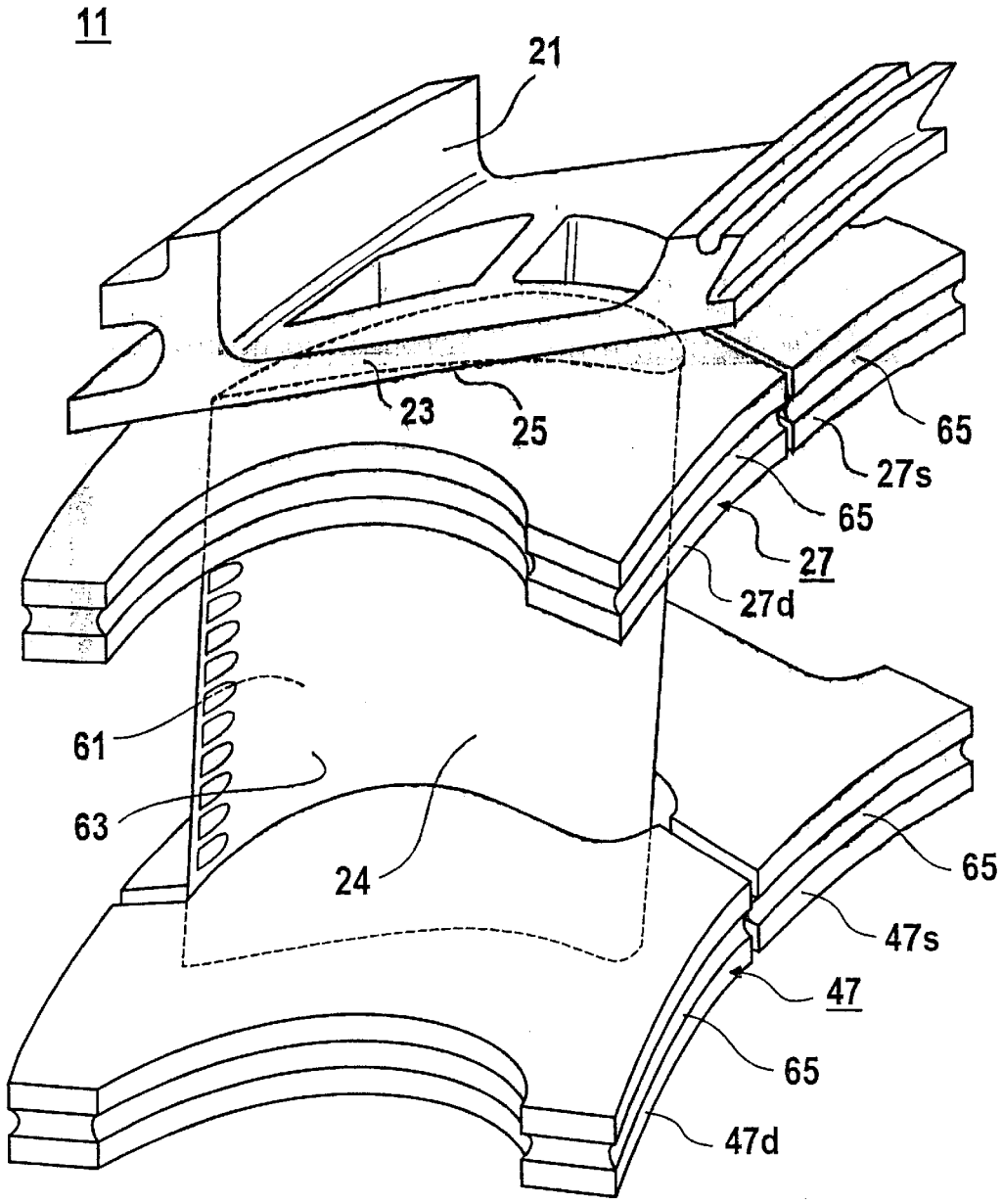
FIG. 3 shows a gas turbine guide vane.

FIG. 3 shows a gas turbine guide vane 11. The gas turbine guide vane 11 corresponds to the gas turbine guide vane 11*b* of FIG. 2. The construction of the ceramic covering 27 is shown in more detail. This ceramic covering includes two halves 27*d*, 27*s*. In this arrangement, one half 27*d* is adjacent to a pressure surface 63 of the vane aerofoil 24. The second half 27*s* is adjacent to the suction surface 61 of the vane aerofoil 24. On its narrow sides, the ceramic covering 27 has a longitudinal groove 65 extending round these narrow sides.

In a similar manner, the second ceramic covering 47 is subdivided into two halves 47*d*, 47*s* and likewise has a peripheral groove 65. The fastening region 21 corresponds to the fastening region 21*b* of FIG. 2. The metal platform 23, with its surface 25 on the hot gas duct side, corresponds to the metal platform 23*b*, with its surface 25*b* on the hot gas duct side, of FIG. 2.

Figure 4:
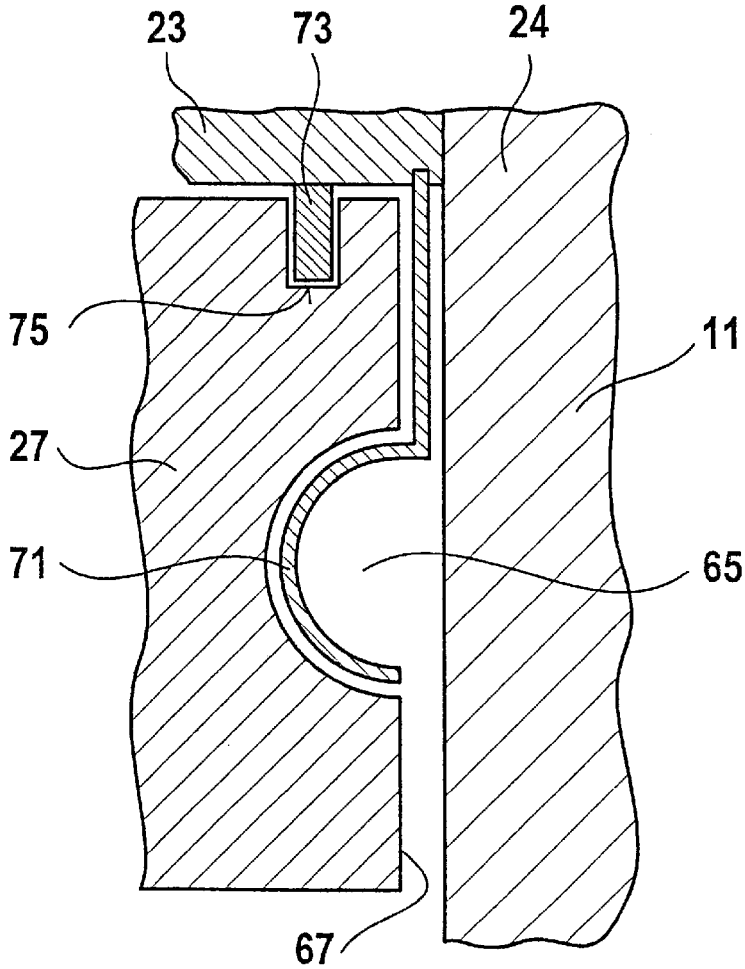
FIG. 4 shows the fastening of a ceramic covering.

FIG. 4 shows how a ceramic covering 27 is connected to the gas turbine guide vane 11. By way of at least its narrow side 67 facing toward the vane aerofoil 24, the ceramic covering 27 is in engagement, by way of the groove 65, with a mechanical fastening element 71, which is connected as a sprung panel to the metal platform 23. By way of this sprung retention of the ceramic covering 27, the latter is securely held and damped against shocks or vibrations to which the gas turbine guide vane 11 is subjected. Additional security against slipping on the surface 25 of the metal platform 23 is provided by a fixing pedestal 73, which is arranged on the surface 25 and engages in a hole 75 in the ceramic covering 27.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine blade, comprising:

a blade aerofoil; and a platform region, adjacent to the blade aerofoil, bounding a hot gas duct of a gas turbine in which the gas turbine blade is installable, wherein the platform region includes a platform on which a ceramic covering is supported and fastened by way of a mechanical fastening element.

2. The gas turbine blade as claimed in claim 1, wherein the ceramic covering includes two halves.

3. The gas turbine blade as claimed in claim 2, wherein a first half of the halves is adjacent to a suction surface of the blade aerofoil, and the other half is adjacent to a pressure surface of the blade aerofoil.

4. The gas turbine blade as claimed in claim 1, wherein the mechanical fastening element is a spring being firmly connected to the gas turbine blade.

5. The gas turbine blade as claimed in claim 4, wherein the spring engages in a groove of the ceramic covering, where the groove extends along a narrow side adjacent to the blade aerofoil.

6. The gas turbine blade as claimed in claim 1, wherein a fixing pedestal is arranged on the metal platform, the pedestal being engaged with the ceramic covering.

7. The gas turbine blade as claimed in claim 1, wherein the gas turbine blade is configured as a guide vane with a second platform region opposite to the platform region enclosing the blade aerofoil, whereby the second platform region has a second platform, on which a second ceramic covering is supported and fastened by way of a second mechanical fastening element.

8. The gas turbine blade as claimed in claim 7, wherein the platforms are made of metal.

9. The gas turbine blade as claimed in claim 1, wherein the ceramic covering has an integral mat, by way of which fragments are held as a composite in the event of a fracture of the ceramic covering.

10. The gas turbine blade as claimed in claim 1, wherein the ceramic covering includes mullite.

11. The gas turbine blade as claimed in claim 10, wherein the ceramic covering has an outer sealing layer to combat particle separation.

12. A gas turbine having a gas turbine blade as claimed in claim 1.

13. The gas turbine as claimed in claim 12, wherein the gas turbine blade is arranged, in an axial direction of a hot gas duct, between two rotor blades, and a second ceramic covering extends in the axial direction in such a manner that the rotor blade fails to come into contact therewith.

14. The gas turbine blade as claimed in claim 1, wherein the platform is made of metal.

15. The gas turbine blade as claimed in claim 14, wherein a fixing pedestal is arranged on the metal platform, the pedestal being engaged with the ceramic covering.

16. A blade ring including a least one gas turbine blade as claimed in claim 1.

17. A blade ring including at least two gas turbine blades as claimed in claim 1, where the ceramic covering of the at least two gas turbine blades is joined together.

18. The gas turbine blade of claim 1, comprising a second platform region, adjacent to the blade aerofoil, including a second ceramic covering.

19. The gas turbine blade of claim 18, wherein each of the ceramic coverings include two halves.

20. The gas turbine blade as claimed in claim 19, wherein a first half of the halves is adjacent to a suction surface of the blade aerofoil, and the other half is adjacent to a pressure surface of the blade aerofoil.

* * * * *